US007757315B2

(12) United States Patent
Lopez-Rettew

(10) Patent No.: US 7,757,315 B2
(45) Date of Patent: Jul. 20, 2010

(54) MATTRESS WRAP SET

(76) Inventor: Yolanda Lopez-Rettew, 3545 Rockrose Dr., Corona, CA (US) 92882

( * ) Notice: Subject to any disclaimer, the term of this patent is extended or adjusted under 35 U.S.C. 154(b) by 0 days.

(21) Appl. No.: 11/786,055

(22) Filed: Apr. 9, 2007

(65) Prior Publication Data

US 2008/0244829 A1 Oct. 9, 2008

(51) Int. Cl.
*A47C 9/04* (2006.01)

(52) U.S. Cl. ..... 5/493; 5/485; 5/496; 5/497

(58) Field of Classification Search ..... 5/493, 5/495–499, 484
See application file for complete search history.

(56) References Cited

U.S. PATENT DOCUMENTS 3,570,026 A * 3/1971 Allison ..... 5/486
4,899,408 A * 2/1990 Illingworth ..... 5/484
5,003,655 A * 4/1991 Kafai ..... 5/496
7,370,380 B2 * 5/2008 DeFranks et al. ..... 5/691

* cited by examiner

*Primary Examiner*—Michael Trettel
(74) *Attorney, Agent, or Firm*—Mintz, Levin, Cohn, Ferris, Glovsky & Popeo, P.C.

(57) ABSTRACT

A mattress wrap set is disclosed, providing an easy way to cover a mattress with a sheet, and remove the sheet from the mattress. The mattress wrap set includes a wrap sheet to cover the sides of a mattress and having a top edge that is inelastic. The top edge includes four right-angled corners and is adapted to cover a periphery of the top of the mattress. The mattress wrap set further includes a top sheet to cover at least most of the top of the mattress, and a plurality of fasteners, with one fastener located at each right-angled corner to removably connect the top sheet to the wrap sheet.

7 Claims, 8 Drawing Sheets

MATTRESS WRAP SET

BACKGROUND

The conventional standard for bedding is a sheet set that typically includes a fitted sheet that elastically attaches over the four corners of a mattress to cover the top, sides and at least part of the bottom of the mattress.

However, in uses where the fitted sheet may become soiled, such as when used on an infant's mattress in a crib, changing the fitted sheet is very challenging and time-consuming. With the infant mattress, for example, to change a fitted sheet a crib "bumper" must first be removed, and the mattress must then be lifted out of what is usually a tight fit within the walls of the crib. Then, often before replacing the mattress back into the crib, a crib "skirt" must be realigned and reordered on a spring platform on which the mattress is placed.

One solution to the problems for infant mattresses above is disclosed in U.S. Pat. No. 5,003,655, to Kafai. The Kafai patent discloses a peripheral edge cover having a peripheral side panel for covering the side of the mattress. The panel has upper and lower edges, each having elasticized material incorporated at least partially therein, for extending continuously about the top and bottom surfaces of the mattress. However, the elasticized upper and lower edges of the Kafai cover obscure the corners of the peripheral side panel and make them very unnoticeable, making it very difficult to accurately align the peripheral edge cover on the mattress, or to efficiently position the edge cover around the mattress.

SUMMARY

The above problem and limitations of the art are addressed by a mattress wrap set described below. A mattress wrap set includes a wrap sheet and a top sheet that is releasably attached onto the wrap sheet. The wrap sheet covers the sides and a portion of a periphery of the top and bottom of a mattress, while the top sheet can be easily placed onto and removed from the top of the mattress.

In preferred implementations, the wrap sheet includes a band of fabric having a first edge that is elastic and a second edge that is inelastic and includes four right-angled corners. The band of fabric is sized to cover the sides of a rectangular mattress and a periphery of the top and bottom of the rectangular mattress when the elastic first edge is fitted on the periphery of the bottom of the mattress to align the four right-angled corners of the inelastic edge at respective top corners of the rectangular mattress.

In another aspect, a mattress wrap set includes a wrap sheet to cover the sides of a mattress and having a top edge that is inelastic, the top edge including four right-angled corners and adapted to cover a periphery of the top of the mattress. The mattress wrap set further includes a top sheet to cover at least most of the top of the mattress, and a plurality of fasteners, one fastener located at each right-angled corner to removably connect the top sheet to the wrap sheet.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
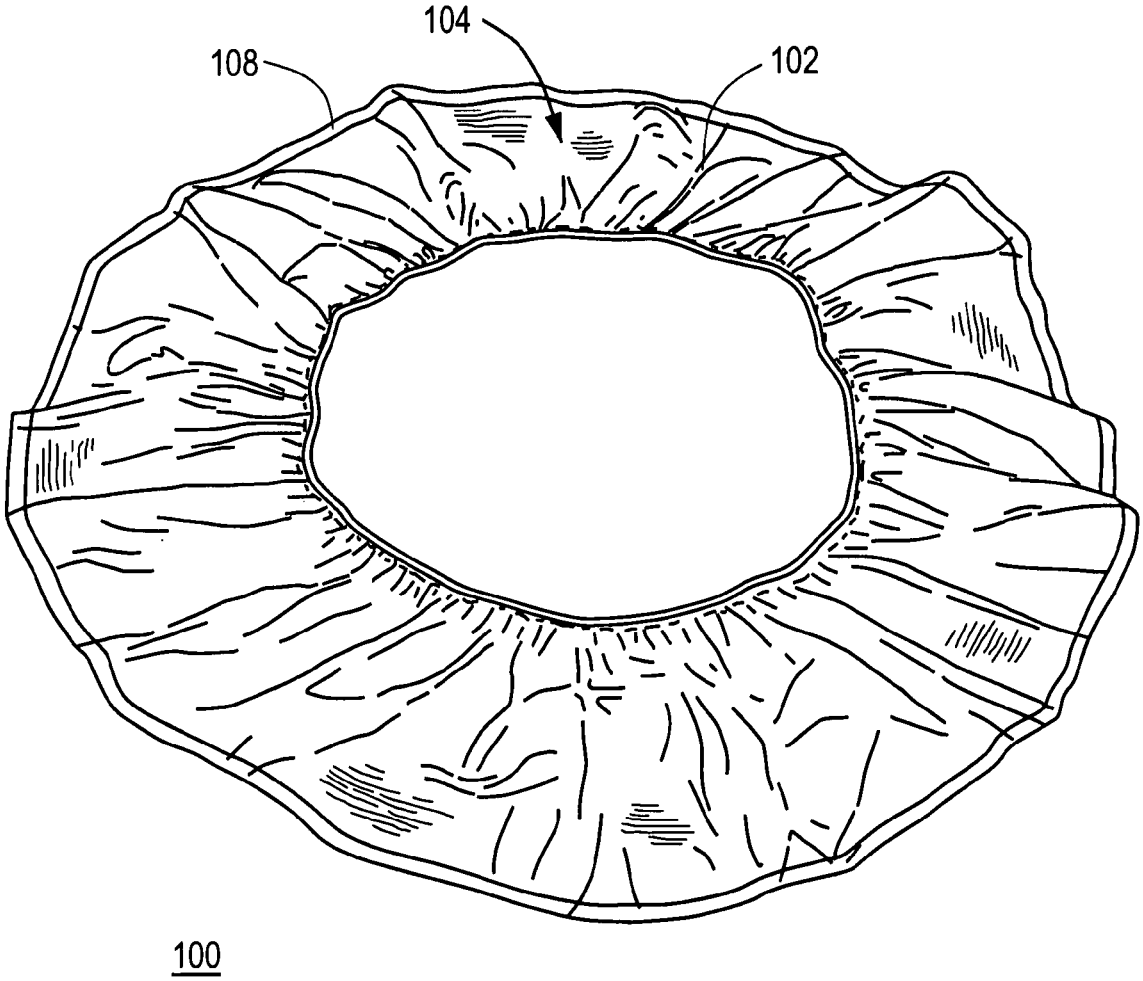
FIG. 1 illustrates a wrap sheet for a mattress.
Figure 2:
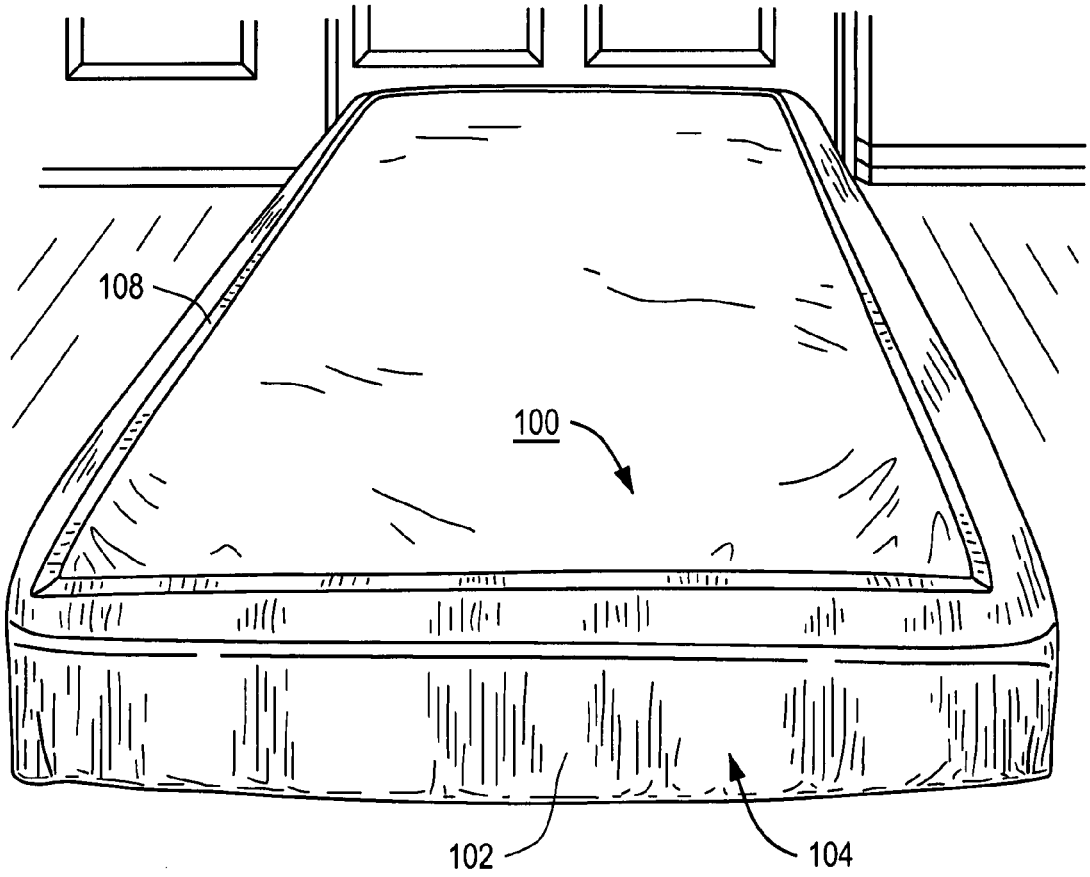
FIG. 2 is a top view of a wrap sheet.
Figure 3:
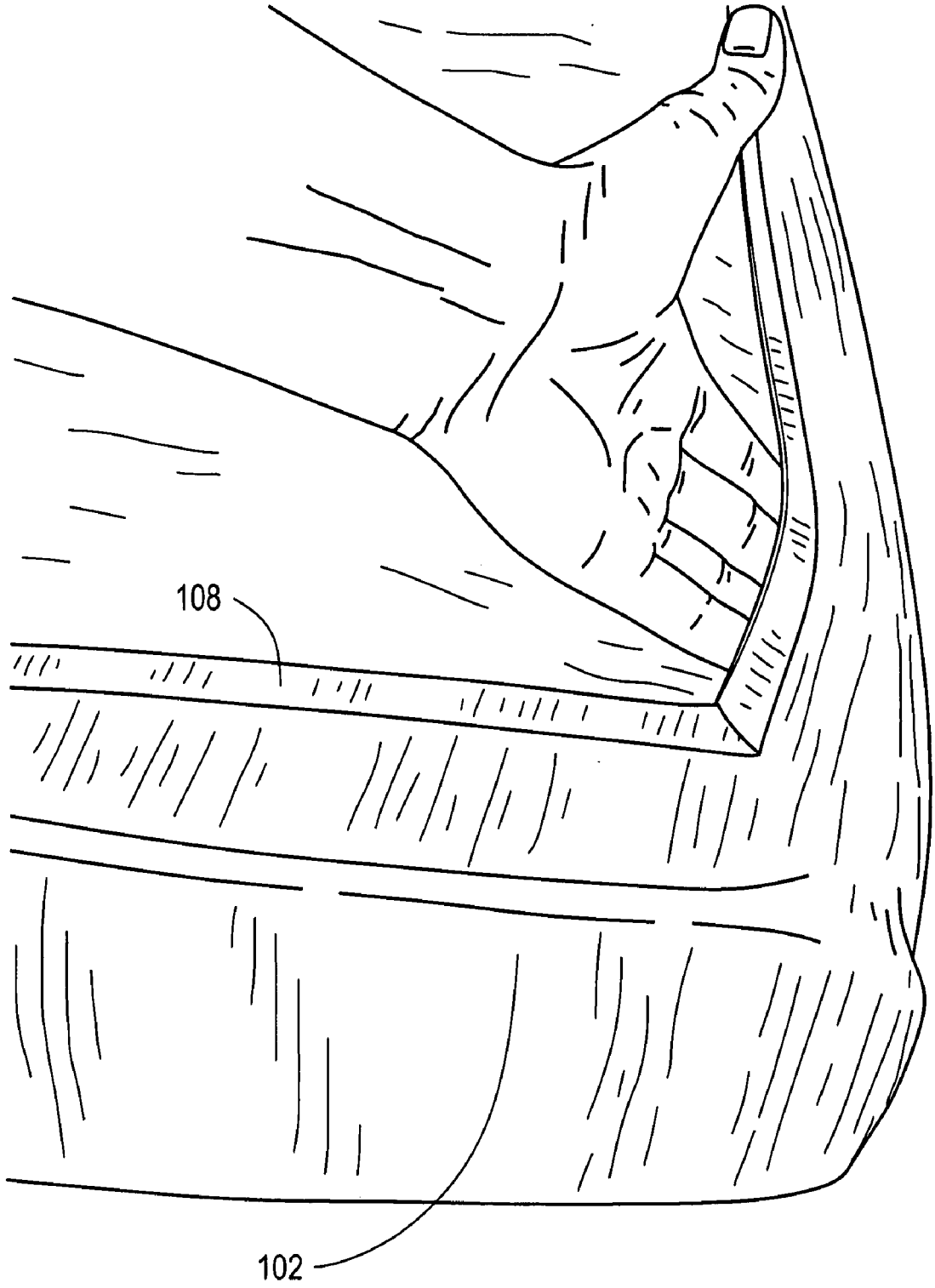
FIG. 3 is a top corner view of a wrap sheet.
Figure 4:
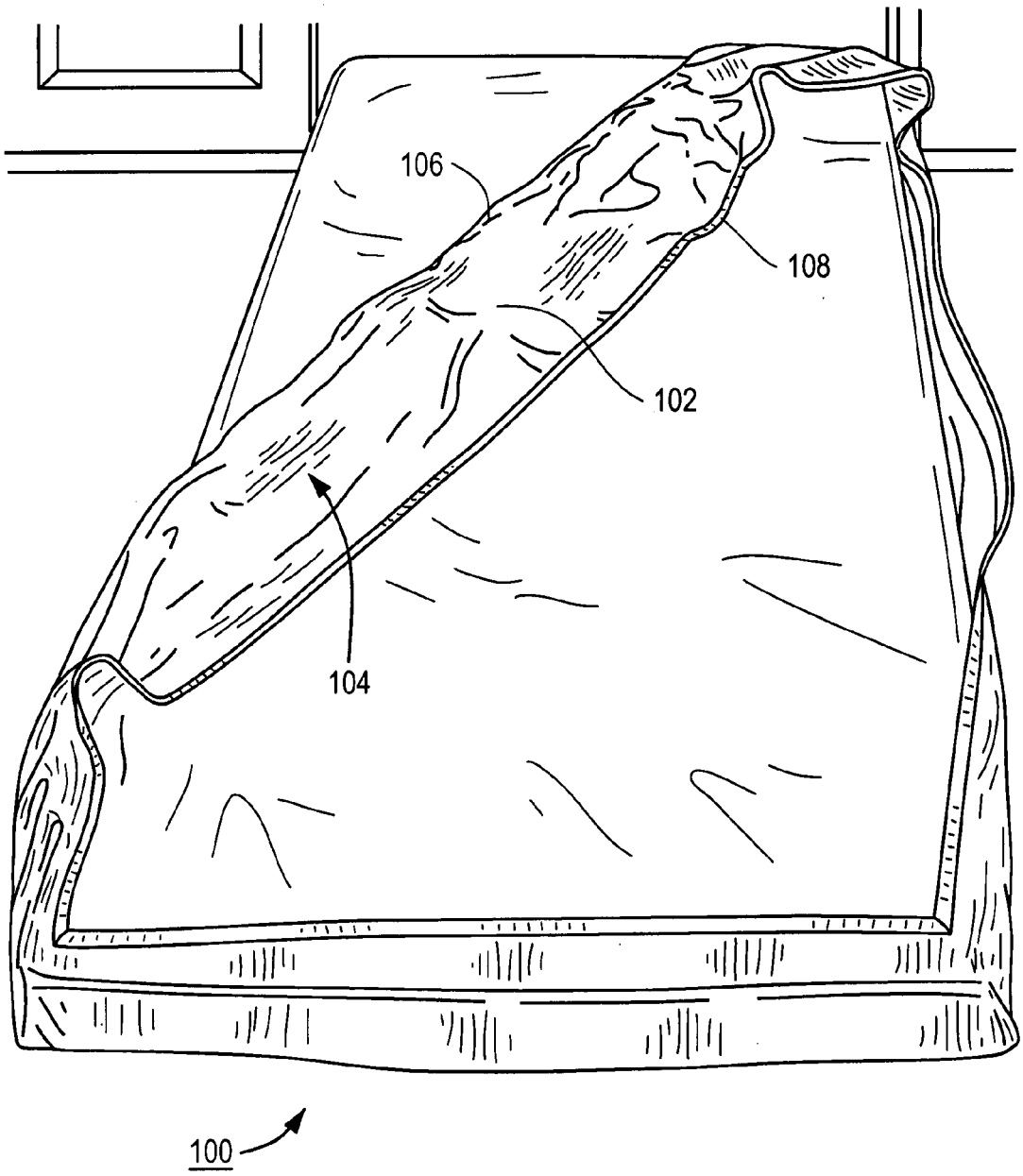
FIG. 4 is a top angle view of a partially positioned wrap sheet.
Figure 5:
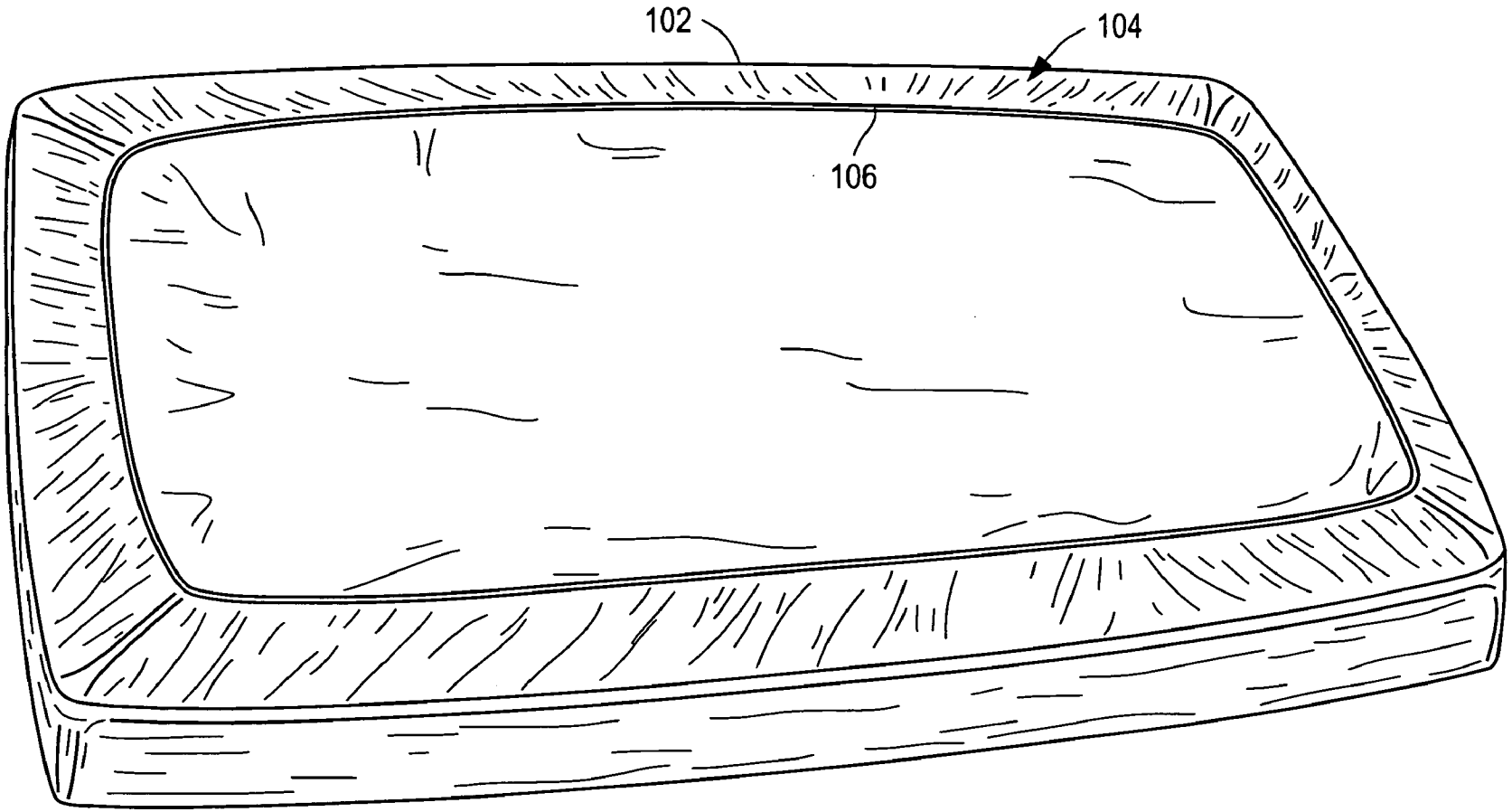
FIG. 5 is a bottom view of a wrap sheet.
Figure 6:
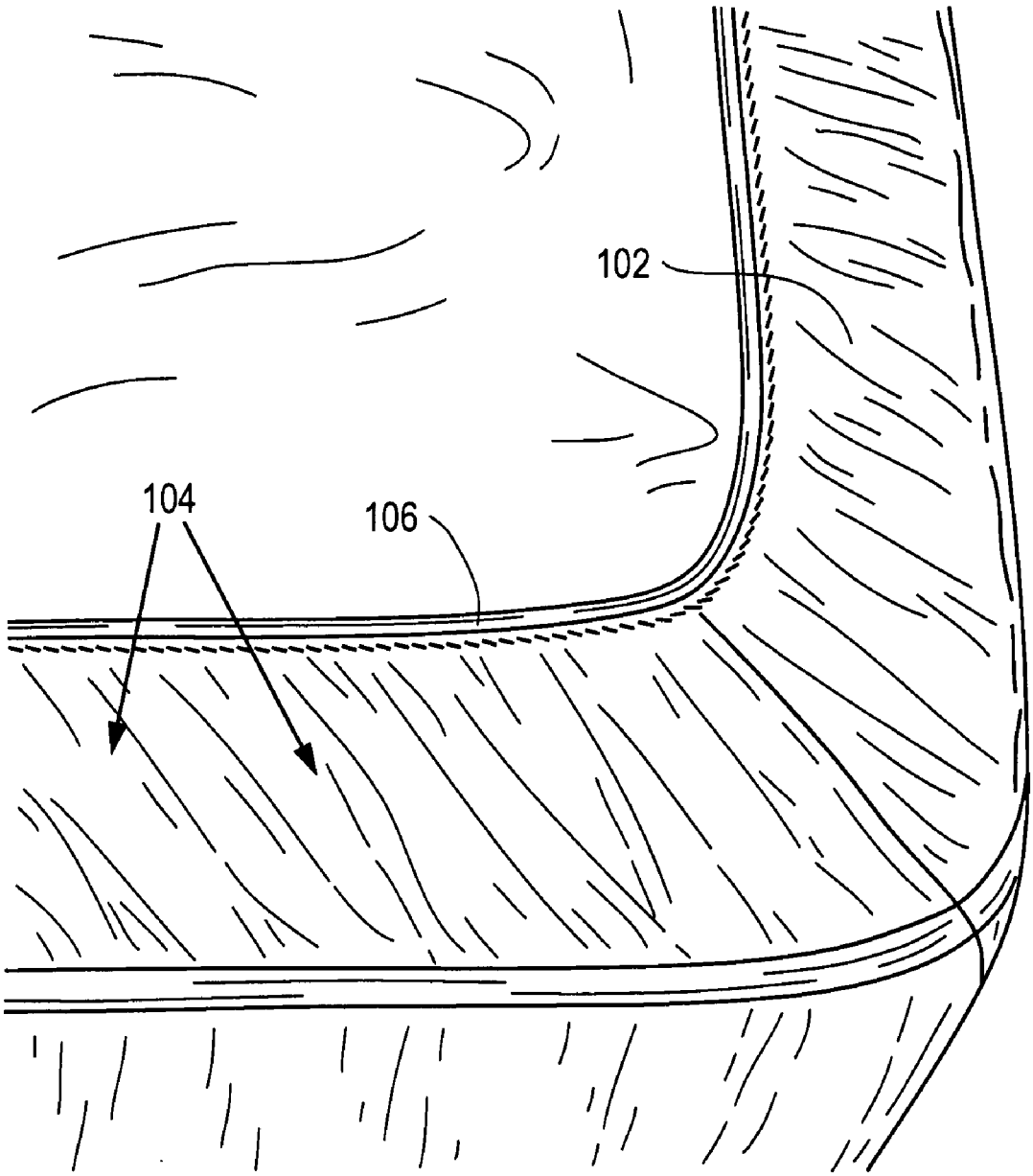
FIG. 6 is a bottom corner view of a wrap sheet.

This document describes a mattress wrap set that includes a wrap sheet to cover the sides and at least a periphery of the top of a mattress, a top sheet to cover at least most of the top of the mattress, and a fastening mechanism to removably attach the top sheet to the wrap sheet. In accordance with embodiments, a mattress is any size, but generally of an elongated and rectangular six-sided polyhedron shape, having a top, a bottom and four sides. Accordingly, the term "sides" applies to head and foot sides as well as to opposing lateral sides.

In preferred implementations, the wrap sheet includes a band of fabric having a first edge that is elastic and a second edge that includes four right-angled corners. The band of fabric is sized to cover the sides of a rectangular mattress and a periphery of the top and bottom of the rectangular mattress when the elastic first edge is fitted on the periphery of the bottom of the mattress to align the four right-angled corners of the inelastic edge at respective top corners of the rectangular mattress.

With reference to FIGS. 1-6, illustrating various views of a wrap sheet 100 for a mattress, the wrap sheet 100 includes a band 102. The band 102 can be made of any fabric or material, such as cotton, nylon or polyester, and can include an ornamental outer surface 104 that has color(s), pattern(s) and/or ornamental graphic(s). The band 102 can be made of a single or multiple bands of fabric that are attached or sewn together.

The band 102 further includes an elastic edge 106 provided at a lower edge of the band 102. The elastic edge 106 can be implemented using an elastic cord or band, in a seam, or as a set of two or more elastic cords or bands each aligned at a corner of the band 102, that are adapted to traverse a corner of the bottom of the mattress. The band 102 further includes an inelastic edge 108 provided at an upper edge of the band 102. The inelastic edge 108 includes four right-angled (i.e. approximately 90 degree) corners, preferably formed by a cord or seam or collar.

The wrap sheet 100 is sized and adapted to cover the sides of a rectangular mattress. In addition, the wrap sheet 100 is sized and adapted to cover a periphery of the top and bottom of the mattress. For example, the band 102 can cover the periphery of the bottom of the mattress when the elastic edge 106 is placed around the bottom of the mattress, and the four square corners of the inelastic edge 108 are easily positioned or aligned at respective corners of the periphery of the top of the mattress.

Figure 7:
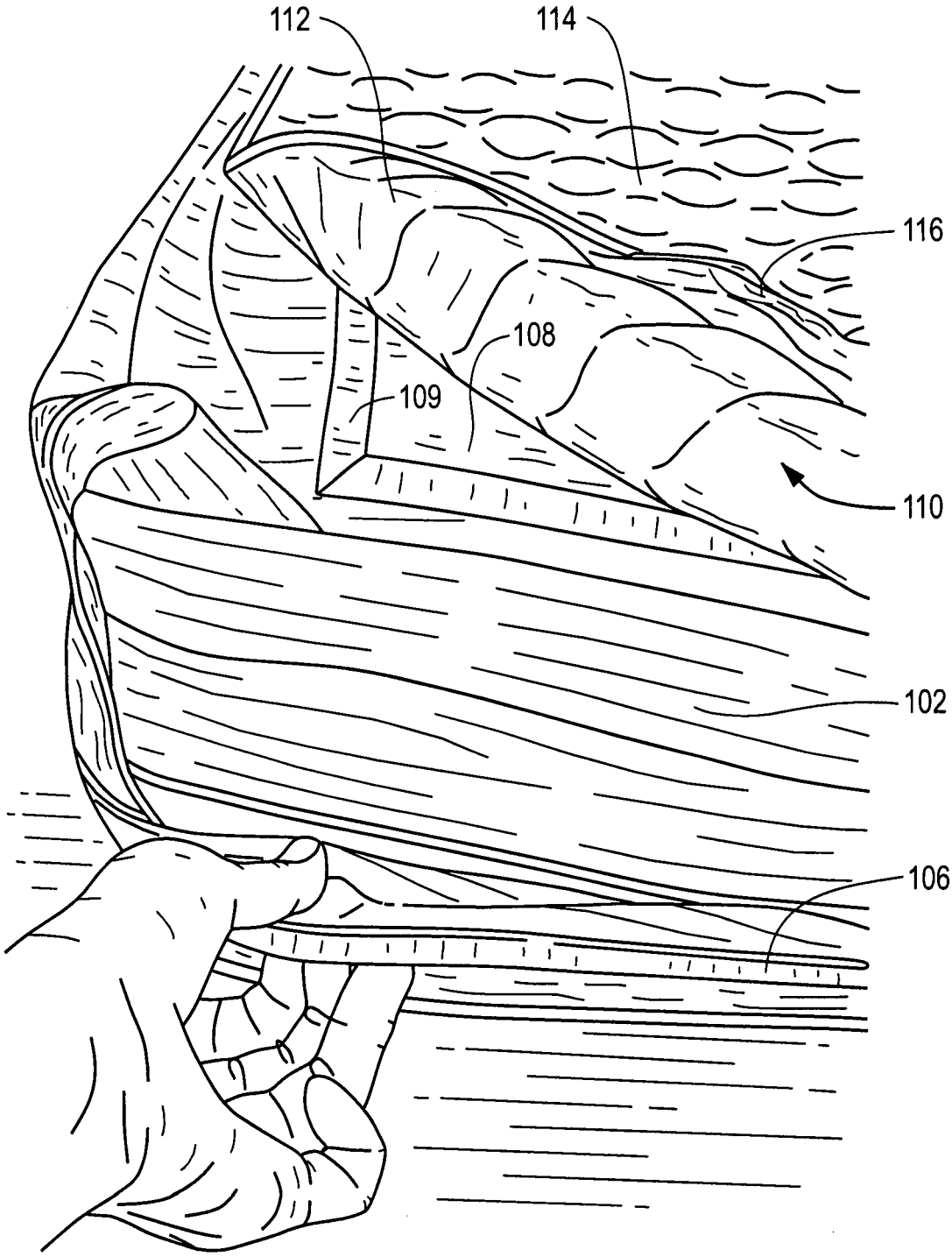
FIG. 7 illustrates a mattress wrap set having a wrap sheet and top sheet.
Figure 8:
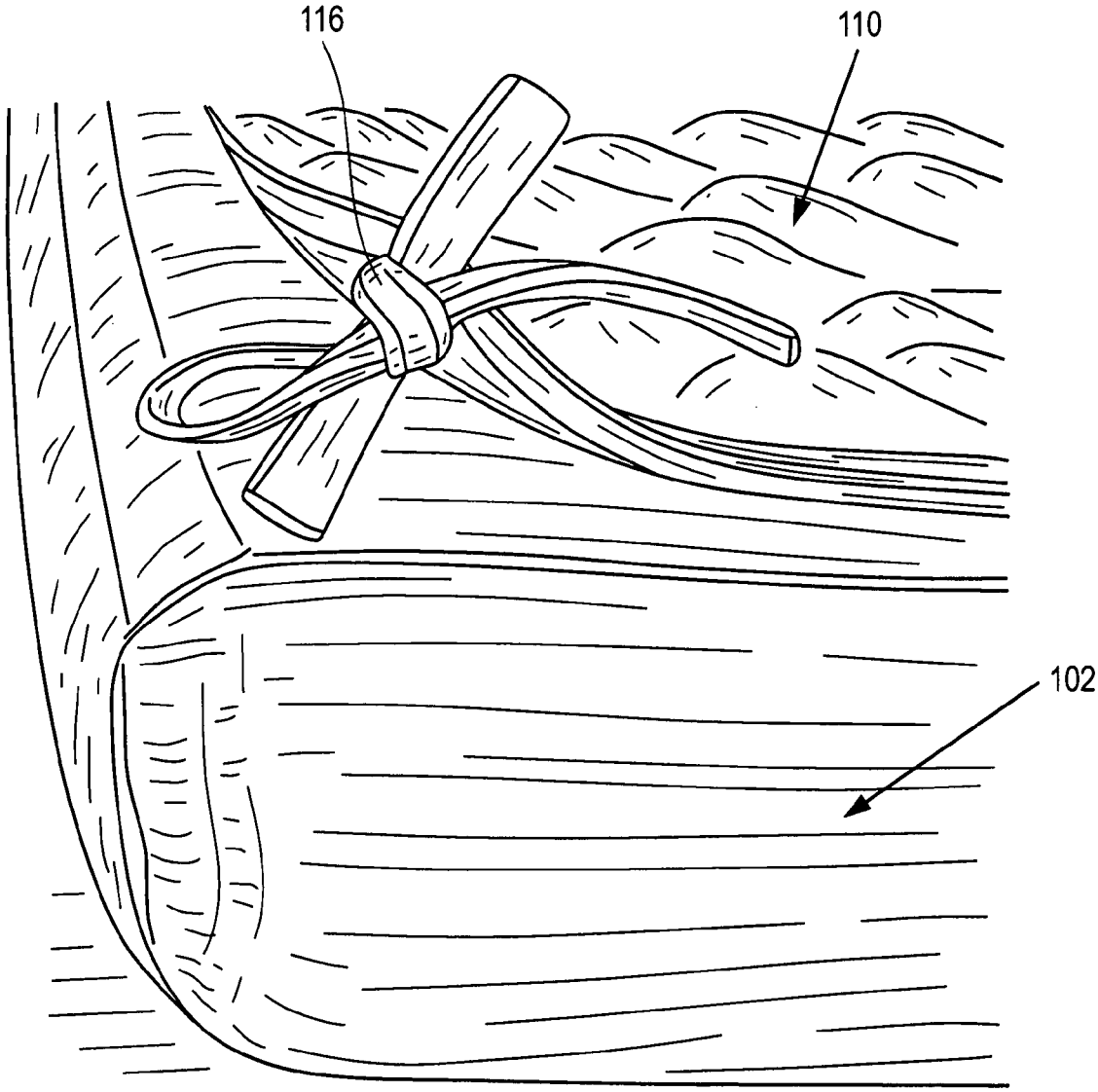
FIG. 8 illustrates a mattress wrap set.

FIGS. 7 and 8 illustrates a mattress wrap set 101, having a wrap sheet formed of a band 102 of fabric having an elastic edge 106 and an inelastic edge 108. The inelastic edge includes four right-angled corners 109. The band 102 of fabric is sized to cover the sides of a mattress and a periphery of the top and bottom of the mattress when the elastic edge 106 is fitted on the periphery of the bottom of the mattress, allowing the four right-angled corners 109 of the inelastic edge 108 to be aligned at respective top corners of the mattress. The wrap sheet may further include a first fastener (not shown) positioned at each right-angled corner 109 of the inelastic edge 108.

The mattress wrap set 101 further includes a top sheet 114. The top sheet 114 has second fasteners 116 provided at corners of the top sheet 114. In preferred implementations, each second fastener 116 is adapted to attach to a squared corner 109 of the wrap sheet, and preferably to an associated first fastener, to secure the top sheet 114 to the wrap sheet so that the top sheet 114 covers at least most of the top of the mattress. The fasteners of the first and second fasteners can include one or more ties, hook and loop type fasteners, snaps, buttons, or any other type of fastener.

Although a few embodiments have been described in detail above, other modifications are possible. Other embodiments may be within the scope of the following claims.

What is claimed:

1. A mattress wrap set, comprising:

a wrap sheet comprising a band of fabric having a first edge that is elastic and a second edge that is inelastic and includes four right-angled corners that define a squared opening, the band of fabric being sized to cover the sides of a mattress and a periphery of the top and bottom of the mattress when the elastic first edge is fitted on the periphery of the bottom of the mattress to align the four right-angled corners of the inelastic edge at respective top corners of the mattress, and further including a plurality of first fasteners each positioned at a right-angled corner of the inelastic edge on a top side of the second edge; and a top sheet having a plurality of second fasteners, each second fastener adapted to attach to an associated first fasteners to secure the top sheet to the wrap sheet so that the top sheet covers the second edge of the band of fabric on the top of the mattress, the top sheet further having a waterproof layer.

2. A mattress wrap set in accordance with claim 1, wherein the fasteners of the first and/or second fasteners are selected from the group of fasteners that consists of ties, snaps, button/button holes, and hook and loop type fasteners.

3. A mattress wrap set in accordance with claim 1, wherein the band of fabric includes an ornamental outer surface.

4. A mattress wrap set in accordance with claim 1, wherein the plurality of second fasteners are each further adapted to detach from its associated first fastener so that the top sheet is removable from the top of the mattress.

5. A mattress wrap set, comprising:

a wrap sheet to cover the sides of a mattress and having a top edge that is inelastic, the top edge including four right-angled corners and adapted to cover a periphery of the top of the mattress and to define a squared opening;

a top sheet to cover at least most of the top of the mattress, the top sheet including a waterproof layer; and four fasteners, one of each of the four fasteners being located at one right-angled corner to removably connect the top sheet to the top side of the top edge of the wrap sheet.

6. A mattress wrap set in accordance with claim 5, wherein the fasteners are selected from the group of fasteners that consists of ties, snaps, button/button holes, and hook and loop type fasteners.

7. A mattress wrap set in accordance with claim 5, wherein the wrap sheet further includes a bottom edge that is at least partially inelastic and adapted to be fitted over a peripheral edge of the bottom of the mattress.

* * * * *